US006935739B2

(12) United States Patent
Inoue et al.

(10) Patent No.: US 6,935,739 B2
(45) Date of Patent: Aug. 30, 2005

(54) PRINTING APPARATUS, PRINTING CARTRIDGE, AND COLORANT CONTAINER

(75) Inventors: Ryoji Inoue, Kanagawa (JP); Hiroyuki Ishinaga, Tokyo (JP); Nobuyuki Kuwabara, Tokyo (JP); Tetsuya Ohashi, Chiba (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/671,784

(22) Filed: Sep. 29, 2003

(65) Prior Publication Data

US 2004/0090510 A1 May 13, 2004

(30) Foreign Application Priority Data

Sep. 30, 2002 (JP) ..... 2002-287832

(51) Int. Cl.[7] ..... B41J 29/00
(52) U.S. Cl. ..... 347/104; 347/86; 400/693
(58) Field of Search ..... 400/88, 691, 693; 347/104, 85, 86, 87

(56) References Cited

U.S. PATENT DOCUMENTS 5,502,479 A 3/1996 Ishinaga et al. ..... 347/93
5,512,925 A 4/1996 Ohashi ..... 347/86
5,534,902 A * 7/1996 Hoesly ..... 347/104
5,896,152 A 4/1999 Ohashi ..... 347/86
6,152,630 A * 11/2000 Scarton et al. ..... 400/642
6,628,430 B1 * 9/2003 Silverbrook et al. ..... 358/473

FOREIGN PATENT DOCUMENTS

JP 08156243 A * 6/1996

* cited by examiner

*Primary Examiner*—Daniel J. Colilla
*Assistant Examiner*—Jill E. Culler
(74) *Attorney, Agent, or Firm*—Fitzpatrick, Cella, Harper & Scinto

(57) ABSTRACT

In the printing apparatus, the printing region, the paper-conveying roller region and the ink (printing agent) region are arranged on a straight line generally parallel to the plane containing the printing region. Thereby, it is possible to accommodate the increase in the printing region or the ink (printing agent) region in an area on the straight line. Accordingly, the reduction of the running cost is realized by a printing agent container of a large capacity, while enabling the high-speed printing by ensuring the large printing region surface in the thin and small-sized printing apparatus.

13 Claims, 10 Drawing Sheets

PRINTING APPARATUS, PRINTING CARTRIDGE, AND COLORANT CONTAINER

This application claims priority from Japanese Patent Application No. 2002-287832 filed Sep. 30, 2002, which is incorporated hereinto by reference.

BACKGROUND OF THE INVENTION

1. Field of the Invention

The present invention relates to a printing apparatus for printing image information on a printing medium, a printing cartridge to be mounted to the printing apparatus, and a colorant container.

2. Description of the Related Art

Generally speaking, in an ink jet printing apparatus in which ink is ejected from a plurality of printing elements as droplets to form an image on a printing medium, a distance between an ink ejection surface of an printing head and the printing medium (hereinafter merely referred to as "paper distance") largely effects upon image quality. For example, the ejecting direction of ink droplets ejected from a plurality of printing elements arranged on the printing head slightly scatters by all means. Also, a scanning speed of a carriage carrying the printing head somewhat varies. In such a case, a landing point of the ink droplet varies on the printing medium, and an amount of the variation becomes larger as the paper distance increases to deteriorate the image quality. On the other hand, however, if the paper distance is excessively short, there is a risk in that the ink ejection surface may be brought into contact with the printing medium due to the undulation of the printing medium. Accordingly, in an area in which the printing head carries out the printing operation, the printing medium is preferably in a tense state to maintain the paper distance within a predetermined range.

FIG. 1 is a sectional view for explaining a structure of a conventional ink jet printing apparatus in the prior art.

In FIG. 1, reference numeral 11 denotes a pickup roller; 13 denotes a printing medium; 12 denotes a paper-feed tray for carrying a stack of non-printed printing media 13; 14 denotes a feed roller; 15 denotes a pinch roller; 16 denotes a platen; 17 denotes a cartridge in which ink tanks and a printing head are integral with each other; 18 denotes a delivery roller; 19 denotes a nip roller; and 20 denotes a paper-delivery tray.

When a command for commencing the printing operation is given by a host computer or others, the pickup roller 11 begins to rotate in the direction indicated by an arrow in the drawing (in the clockwise direction) to feed the printing medium 13 one by one from the topmost of the stack in the paper-feed tray 12. Thereafter, the printing medium 13 is conveyed while being nipped between the feed roller 14 and the pinch roller 15 and reaches an image printing section on the platen 16. The printing operation is carried out by ejecting ink in accordance with image signals from the respective printing elements in the printing head while reciprocating a carriage (not shown) in the direction vertical to a paper surface of the drawing. The printing medium 13 on which the image has been printed is conveyed outside from the apparatus while being nipped by the delivery roller 18 and the nip roller 19 and placed on the paper-delivery tray 20.

Axial centers of the feed roller 14 and the pinch roller 15 are on the same straight line extending in the vertical direction. This is also true to those of the delivery roller 18 and the nip roller 19. Further, a paper-passing surface (upper surface) of the platen 16 and a contact area of the feed roller 14 with the pinch roller 15 are in the same plane so that the feed roller 14 conveys the printing medium 13 in the horizontal direction. Also, the paper-passing surface (upper surface) of the platen 16 and the contact area of the delivery roller 18 with the nip roller 19 are in the same plane so that the delivery roller 18 conveys the printing medium 13 in the horizontal direction.

Generally speaking, regarding the feed roller 14 and the delivery roller 18, the peripheral velocity is larger in the delivery roller 18 than the feed roller 14 so that the printing medium 13 is conveyed while being pulled by the delivery roller 18. On the other hand, a conveying force of the delivery roller 18 is selected to be sufficiently smaller than that of the feed roller so that the delivery roller 18 pulls the printing medium 13 while sliding in fact on the delivery roller 18. By imparting the printing medium 13 with a proper tension in such a manner, it is possible to flatten the printing medium 13 so that the paper distance d is maintained constant between the ink ejection surface of the ink cartridge 17 and the printing medium 13. Generally, the paper distance d is suitably in a range from approximately 0.7 to 1.2 mm. If it is maintained within this range, there is no influence of the variance in the landing point described above, and the ink ejection surface is prevented from being in contact with the printing medium due to the undulation of the printing medium.

Recently, there has been the requirement for the ink jet printing apparatus to increase the printing speed and reducing the running cost. To realize the speed-up of the printing operation, it is preferable to increase the number of printing elements arranged on the printing head so that a printing width h is widened during one printing scan of the carriage. Also, to reduce the running cost, the enlargement of an ink tank is effective for increasing an amount of usable ink. However, in either case, a size becomes large in the printing apparatus of the conventional type. That is, if the printing width h is widened, a region H between the feed roller 14 and the delivery roller 18 must be also widened to increase the lengthwise dimension of the printing apparatus as whole. On the other hand, to increase the amount of usable ink, it is necessary to enlarge the ink tank, which in turn needs the elongation of the ink tank and the printing apparatus in the height direction relative to the printing region.

In peripheral instruments of a personal computer used around a desk, a thin and vertical type is now being a main trend. For example, a CRT display is replaced by a liquid crystal display, and a personal computer becomes thin and compact to be capable of being comfortably placed on a corner of the desk. Further, in a flat head scanner, a slim type used in the vertical position is being a main trend. In such a situation, the above-mentioned trend is also true to a personal ink jet printing apparatus used around the desk, and a thin and compact type used in the vertical position is required. Accordingly, such a trend contradicts the requirement for the high speed printing and the reduction of running cost which result in the size-enlargement of the apparatus as described above.

SUMMARY OF THE INVENTION

The present invention has been made to solve the above-mentioned problems in the prior art, and an object thereof is to provide a printing apparatus of a thin and compact type, capable of realizing the high-speed printing operation by ensuring a large printing region surface as well as of reducing the running cost by carrying a colorant container of a large capacity.

In a first aspect of the present invention, there is provided a printing apparatus, comprising a printing agent container for storing printing agent, printing means for replenishing the printing agent from the printing agent container and imparting the printing agent to a printing medium from a plurality of printing elements, and a pair of paper-conveying rollers for conveying the printing medium while maintaining the latter in a flat state by supporting the printing medium from front and rear surfaces thereof; wherein a printing region plane opposite to the printing medium, in which the plurality of printing elements of the printing means are arranged, at least part of a paper-conveying roller region occupied with the paper-conveying rollers and at least part of a printing medium region in which the printing agent container is located are arranged on a same straight line contained in the printing region plane.

In a second aspect of the present invention there is provided a printing cartridge having a configuration capable of being mounted to the above printing apparatus, comprising a printing agent container for storing printing agent, and printing means for replenishing the printing agent from the printing agent container and imparting the printing agent to a printing medium from a plurality of printing elements.

In a third aspect of the present invention there is provided a printing agent container detachably mounted to said printing means used in the above printing apparatus.

In a fourth aspect of the present invention there is provided a printing agent container detachably mounted to the printing means constituting the above printing cartridge.

In a fifth aspect of the present invention there is provided a printing apparatus for carrying out the printing operation by using printing means, comprising a first conveying roller for conveying a printing medium on a predetermined conveying path, holding means disposed on the conveying path downstream of the first conveying roller, for holding the printing means, a second conveying roller for conveying the printing medium disposed on the conveying path downstream of the holding means, and a printing material container held by the holding means or the recording means, and extending over the conveying path to a position further downstream of the second conveying roller and closer to the conveying path than the farthest point of the second conveying roller.

In a sixth aspect of the present invention there is provided A recording apparatus for carrying out the printing operation by using printing means, comprising a first conveying roller for conveying a recording medium on a predetermined conveying path, holding means disposed on the conveying path downstream of the first conveying roller, for holding the recording means, a second conveying roller disposed on the conveying path downstream of the holding means, and a recording material container held by the holding means or the recording means, and extending over the conveying path to a position further upstream of the second conveying roller and closer to the conveying path than the farthest point of the first conveying roller.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The preferred embodiments of the present invention will be described below with reference to the attached drawings. In this regard, ink is used as colorant stored in a colorant container (hereinafter referred to as an ink tank) in the following embodiments, the applicable colorant should not be limited to ink. Also, in the technical field of the ink jet printing, ink, of course, includes treatment liquid or others to be applied to a printing medium.

(First Embodiment)

Figure 2:
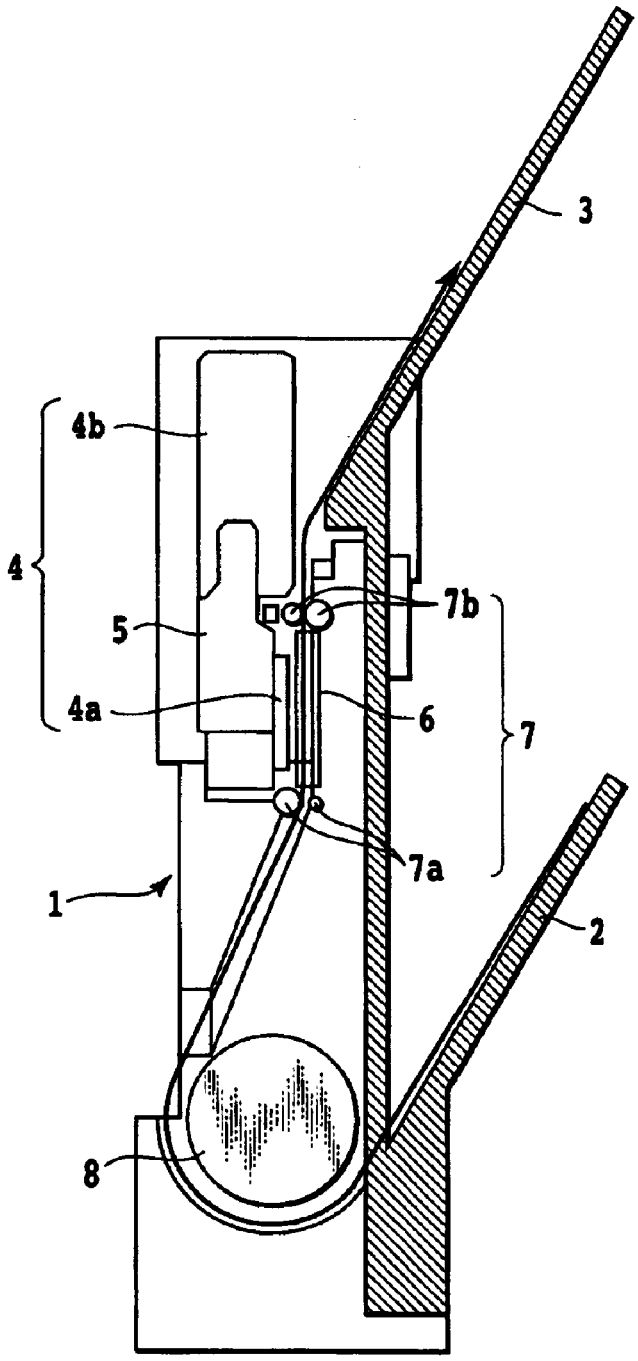
FIG. 2 is a schematic sectional view for explaining the construction of an ink jet printing apparatus according to a first embodiment of the present invention.

FIG. 2 is a sectional view of an ink jet printing apparatus according to a first embodiment of the present invention.

In FIG. 2, reference numeral 1 denotes a body of the ink jet printing apparatus; 2 denotes a paper-feed tray; and 3 denotes a paper-delivery tray for delivering the printing medium after being printed. Except for these two trays, all other members are accommodated in the rectangular parallelepiped body 1 of the ink jet printing apparatus. According to this embodiment, the printing medium is conveyed from the paper-feed tray 2 disposed in a lower portion of the apparatus body to the paper-delivery tray 3 disposed in an upper portion of the apparatus body along a conveying path indicated by an arrow in the drawing. In the midway portion of the conveying path, the printing medium is almost vertical to the installation plane to define a printing region 6 in which the printing operation is carried out on the printing medium by a cartridge 4 disposed in the upper portion of the apparatus body.

The cartridge 4 of this embodiment is formed of a printing head 4*a* for carrying out the ink jet printing and an ink tank 4*b* for supplying ink to the printing head 4*a*. The ink tank 4*b* is coupled to the printing head 4*a* via an ink supply port and disposed generally directly above the printing head 4*a*. In the printing head 4*a*, a plurality of printing elements for ejecting ink are arranged, the arrangement direction of which are parallel to the conveying direction of the printing medium. Reference numeral 5 denotes a carriage which carries the printing head 4*a* and the ink tank 4*b* thereon and is movable in a reciprocated manner along a guide shaft not shown in the direction vertical to a paper on which the drawing is depicted. The ink jet printing apparatus of this embodiment is of a serial type in which an image is formed on the printing medium by alternately repeating the main scanning of the cartridge 5 while ejecting ink from the printing elements of the printing head 4*a* and the conveyance of the printing medium of a predetermined distance along the conveying path.

In the printing region 6, the printing medium defines a vertical plane by means of paper-conveying rollers 7 arranged at front and rear ends of the printing region. A platen is provided in a plane opposite and parallel to a printing element surface of the printing head (hereinafter referred to as a printing section). There is maintained a small gap (the paper distance d) between the printing medium conveyed on the platen and the printing section as described before. According to this embodiment, a length h of the printing section in the cross-sectional view is in a range from 10 to 50 mm, and the paper distance d is maintained within a range from 0.7 to 1.2 mm over the length h.

In the paper-conveying rollers 7, one 7*a* disposed on the upstream side of the conveying path is of a normal type, and the other 7*b* disposed on the downstream side may be a gear-shaped nip roller. In the ink jet printing apparatus, there may be a case in that approximately 0.2 seconds is required for fixing the ejected ink to the printing medium, whereby if the printing medium is in contact with the paper conveying roller immediately after the printing, there is a risk of the deterioration of image quality. Accordingly, by using the gear-shaped nip roller as the paper-conveying roller in contact with the printing medium directly after the printing, it is possible to minimize the contact area with the printing medium to avoid the adverse effect on the printed image.

According to this embodiment, since the paper-conveying roller 7*b* is located in the vicinity of an area in which the printing head 4*a*, the ink tank 4*b* and the carriage 5 carrying them thereon scan, a paper-conveying roller guide is provided so that the paper-conveying roller 7*b* is not brought into contact with the carriage.

Figure 3:
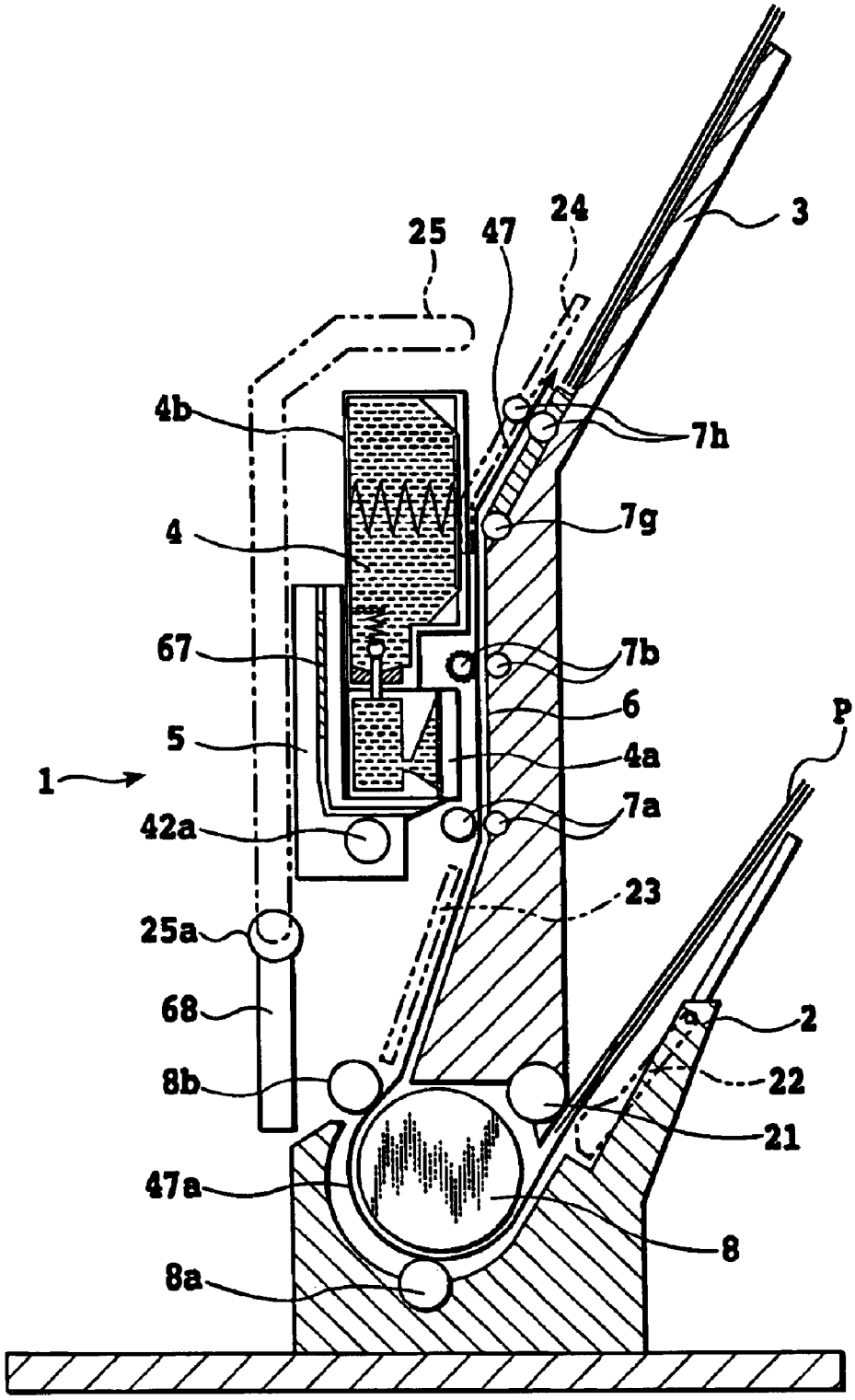
FIG. 3 is a detailed view of the recording apparatus shown in FIG. 2.

FIG. 3 is a detailed illustration of the entirety of the ink jet recording apparatus shown in FIG. 2. In the drawing, reference numeral 21 denotes a pickup roller for feeding the recording medium P placed on the paper-feed tray 2 into the apparatus body. Reference numeral 22 denotes a frictional separating pad for inhibiting the other recording media than that in contact with the pickup roller 21 from being fed into the apparatus body.

The recording medium P fed into the apparatus body by the pickup roller 21 is changed its conveying path 47 to a reversal path 47*a* by a reversal roller 8. In this regard, reference numerals 8*a* and 8*b* denotes pinch rollers for pressing the recording medium onto the reversal roller 8; and 23 denotes a guide plate for guiding the recording medium reversed by the reversal roller 8.

Reference numeral 24 denotes a delivery guide plate for guiding the recording medium on which an image is recorded to a paper-delivery tray; 7*g* denotes a guide roller for guiding and holding the recording medium at a position opposite to the delivery guide plate 24; and 7*h* denotes a pair of delivery rollers for discharging the recording medium to the paper-delivery tray 3.

Reference numeral 42*a* denotes a carriage guide for guiding the carriage 5 when the latter scans in the direction vertical to the conveying direction of the recording medium; and 67 denotes a circuit board provided in the carriage 5.

Reference numeral 25 denotes an openable cover constituting part of an outer case 8 the apparatus body. The openable cover 25 is rotatable about a hinge 25*a* for carrying out the maintenance and/or replacement of the carriage 5, the recording head 4*a* and the ink tank 4*b*.

Figure 4:
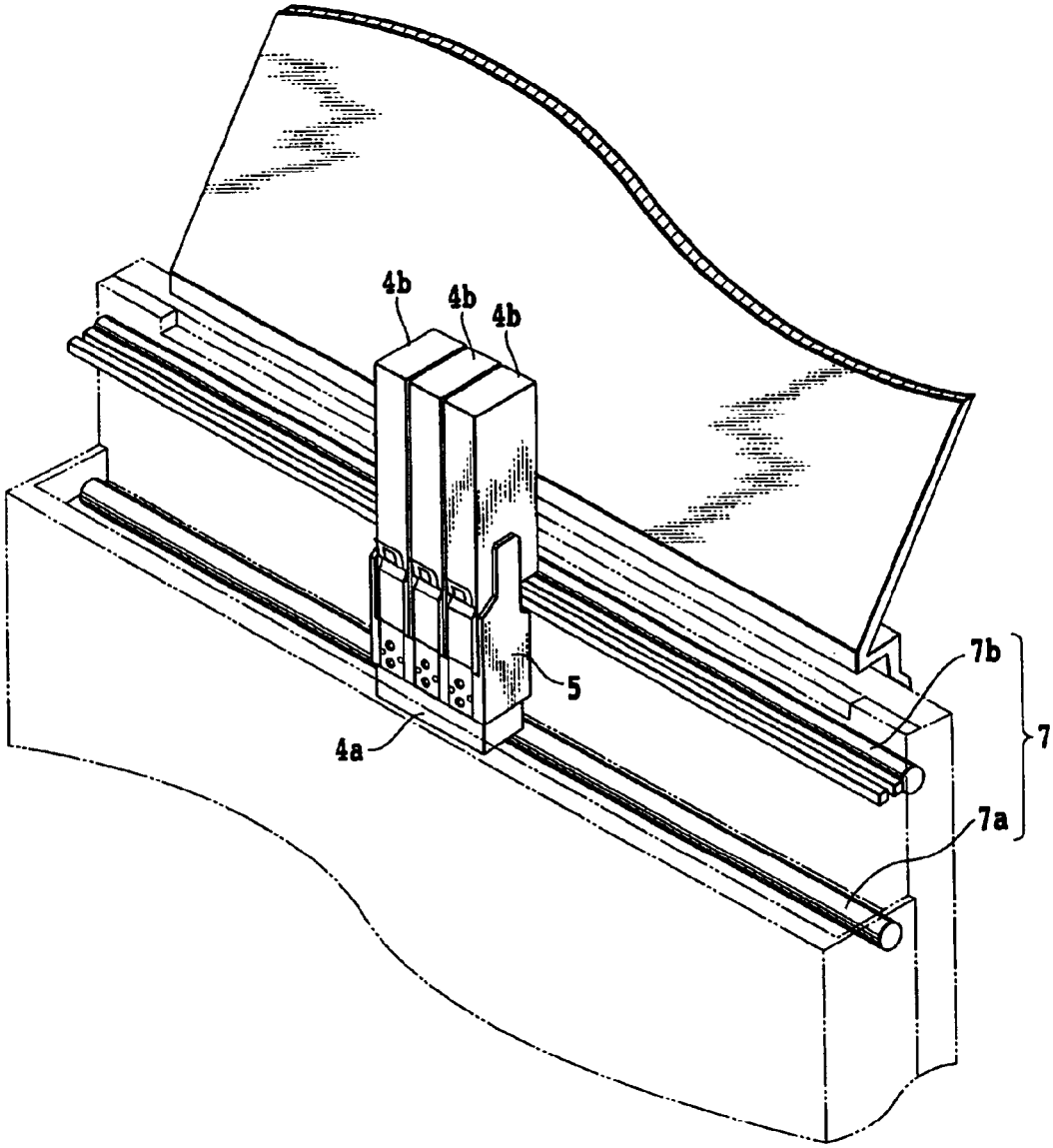
FIG. 4 is a perspective view of the printing apparatus shown in FIG. 2.

FIG. 4 is a schematic perspective view of the ink jet printing apparatus according to this embodiment described with reference to FIG. 2. In the drawing, the ink tank 4*b* consists of three tank sections for cyan, magenta and yellow arranged parallel to each other in the main scanning direction and mounted to the carriage 5 together with the printing head 4*a*. The number and/or colors of the tank sections is variable in accordance with uses of the printing apparatus or images to be output therefrom, and the present invention and the embodiment thereof should not be limited by this example. In such a manner, the printing apparatus is adapted to carry out the printing operation by causing the printing head 4*a* and the ink tank 4*b* to scan parallel to the paper-conveying rollers 7.

Then the printing operation will be described with reference to FIG. 2 again.

The printing operation is commenced when a printing signal is input from a host computer or an operating section of the apparatus body issues a printing-start command. The printing operation starts from the feeding of the printing medium on the paper-feed tray 2. By a drive mechanism disposed in the vicinity of the paper-feed tray 2, the printing media are pressed in the stacked direction for the preparation of being fed to the interior of the printing apparatus. The printing medium in the stack applied with the conveying force is separated one by one by a separating mechanism not shown and brought into tight contact with a reversal roller 8 which rotates to deflect the conveying direction upward. The printing medium which has been deflected its conveying direction is introduced into the printing region 6.

When the printing medium is inserted into the printing region 6, the printing of image data which is made by a host computer or image-processing means in the printing apparatus is started. That is, a process in which the printing head 4*a* mounted on the carriage 5 is subjected to the scanning motion while ejecting ink from the printing elements and a process for conveying the printing medium by a predetermined distance by the paper-conveying rollers 7 in the direction vertical to the scanning motion are alternately repeated.

After the printing on the printing medium has completed, the paper-delivery is started, the printing medium delivered in the direction shown by an arrow is transferred to the paper-delivery tray 3.

Figure 5:
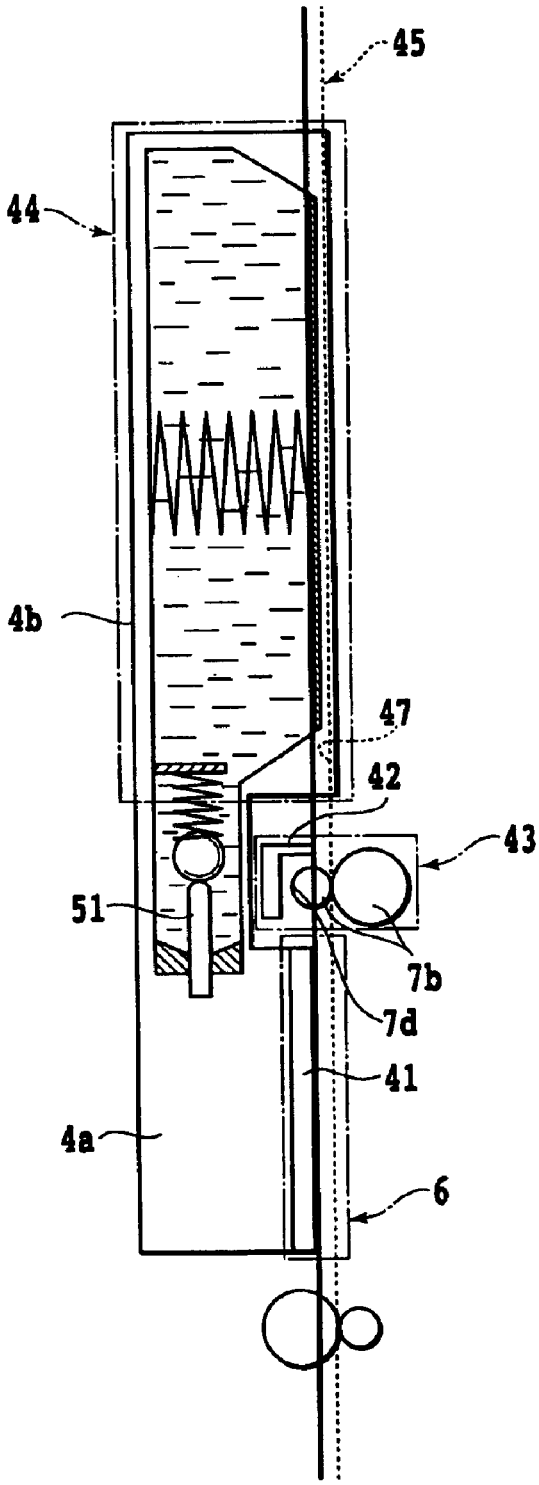
FIG. 5 is an enlarged sectional view for explaining the arrangement of a printing region, a paper feeding region and an ink region in FIG. 2.

FIG. 5 is a schematic sectional view of the printing region 6, the paper-conveying roller region 43 and the ink region 44 illustrating the feature of this embodiment in most detail.

The most characteristic feature of the present invention is the positional relationship between the above-mentioned three regions. A first region is the printing region 6 formed of a printing section 41 in which ink ejection orifices are arranged on the printing head, and a conveying path for the printing medium printed by the printing section 41. A second region is the paper-conveying roller region 43 formed of the paper-conveying roller 7*b* and the paper-conveying roller guide 42. A third region is the ink region 44 formed of ink and the ink tank 4*b* for storing the ink. In the present invention, these three region are generally on a straight line parallel to the printing region extension plane 45 also contained in the printing region 6. In FIG. 5, the printing region 6, the paper-conveying roller region 43 and the ink region 44 are arranged on the straight line indicated by a bold line generally parallel to the printing region extending region 45 indicated by a dotted line.

Figure 1:
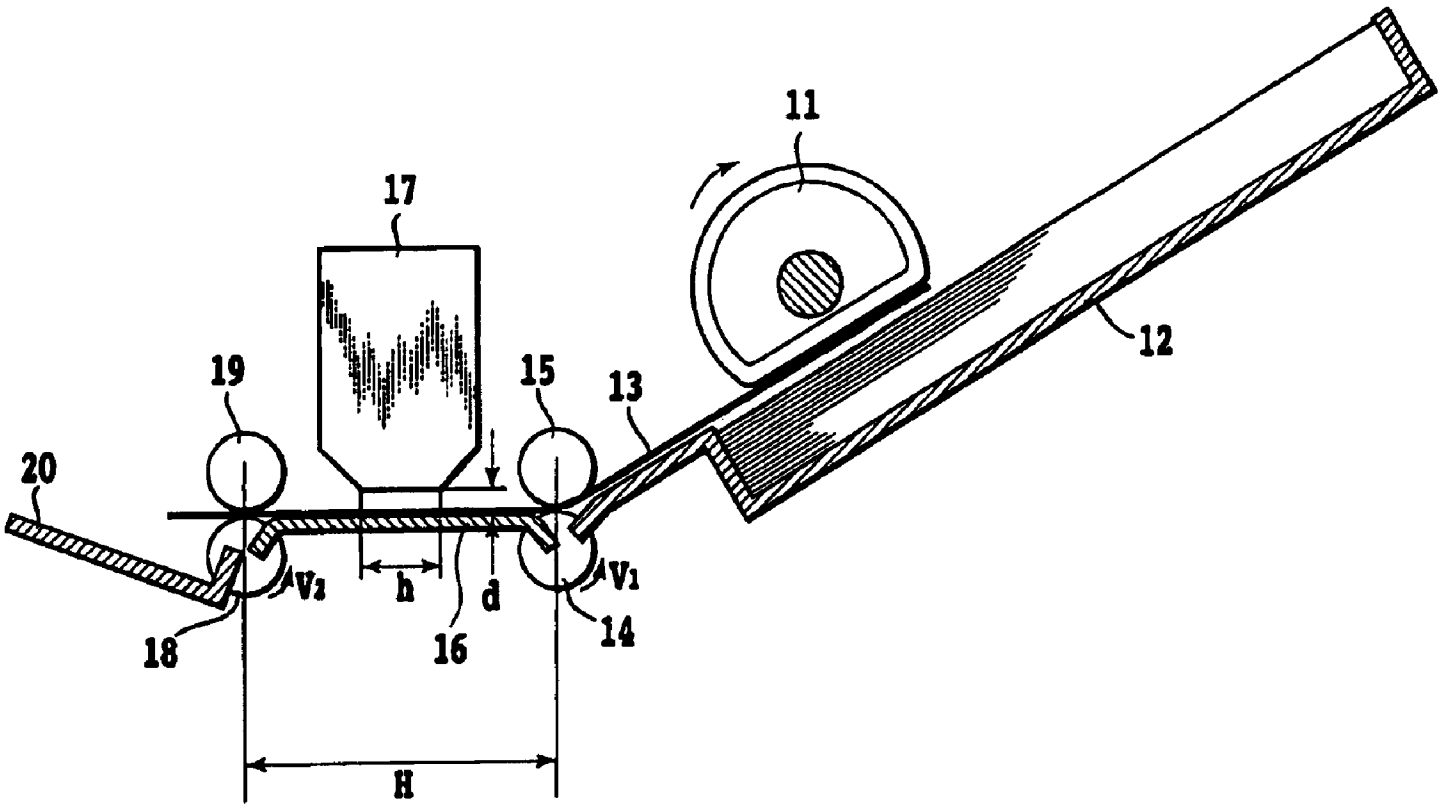
FIG.1 PRIOR ART
FIG. 1 is a schematic sectional view for explaining the construction of an ink jet printing apparatus in the prior art.

By the straight arrangement of the printing region 6, the paper-conveying roller region 43 and the ink region 44 on the straight line in such a manner in the conveying path of the printing medium, it is possible to more effectively use a space in the interior of the printing apparatus in comparison with the prior art described before with reference to FIG. 1 in which the ink region is vertical to the printing region. Particularly, while the paper-conveying roller 7*b* is need to be disposed close to the printing region 6 since the printing medium on which the printing is now being carried out must be held at a proper paper distance by the paper-conveying roller 7*b*, the present invention is characterized in that the ink tank is located at a position downstream of the conveying path over the paper-conveying roller so that ink is supplied therefrom to the printing head.

A further explanation will be made below with reference to FIG. 5. Most part of the ink tank 4*b* in this embodiment is disposed downstream of the paper-conveying roller 7*b* which is in turn disposed downstream of the recording head 4*a*, and is shaped to occupy an area including a region closer to the conveying path 47 than the farthermost point 7*d* from the conveying path 47 of the paper-conveying roller 7*b*.

Further, by compacting the three regions to be arranged on the vertical line as in this embodiment, it is possible to reduce an installation space of the apparatus body as much as possible. In the conveying path of this embodiment described with reference to FIG. 2, a diameter of the reversal roller 8 for deflecting the printing medium from downward to upward finally decides the width of the installation space. That is, all of the three regions; the printing region, the paper-conveying roller region and the ink region; are disposed directly above the reversal roller 8 and capable of being installed within a width smaller than the diameter of the reversal roller 8. This does not enlarge a size of the apparatus body.

According to such a construction, even though the number of printing elements increases to match with the requirement for the high-speed printing or an ink capacity increases in correspondence to the need for the reduction of running cost, it is possible to extend the printing region 6 or the ink region 44 along the printing region extension plane 45. Therefore, there is no risk in that a size of the printing apparatus becomes larger due to the increase in depth or installation area thereof, as in the prior art printing apparatus described with reference to FIG. 1.

In this regard, according to this embodiment, the ink tank improved in efficiency is employed for further reducing the running cost.

Figure 6:
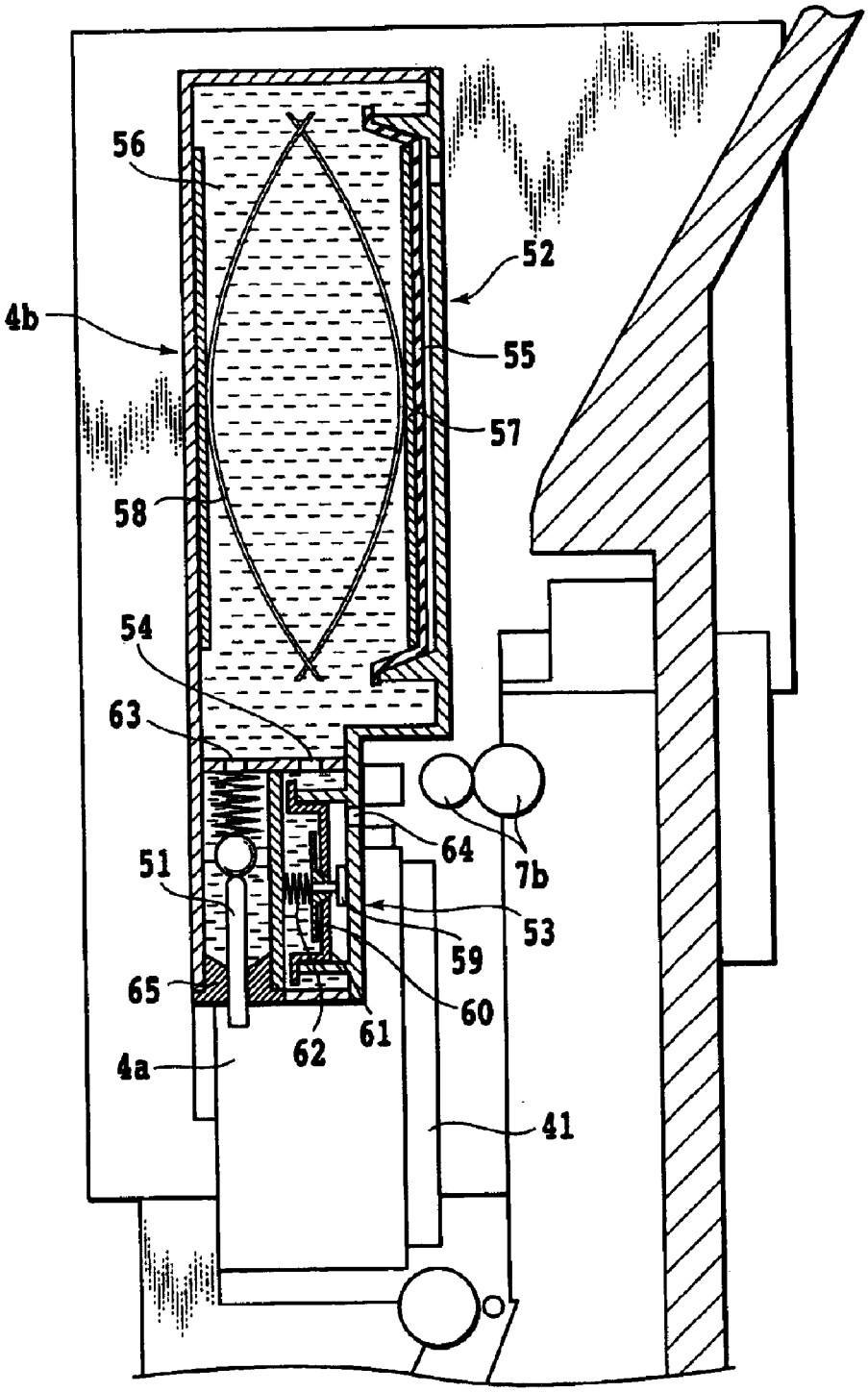
FIG. 6 is an enlarged sectional view for explaining an ink supply path of an ink tank used in the first embodiment of the present invention.

FIG. 6 is an enlarged sectional view of the ink tank 4*b*.

In this embodiment, the ink tank 4*b* is adapted to be attachable to and detachable from the carriage carrying the printing head 4*a* from above. The supply of ink is carried out via a hollow ink-supply needle 51 provided on the carriage upwardly.

The ink tank 4*b* is mainly composed of two chambers; an ink storage chamber 52 defining an ink storage space and a valve chamber 53. The interior of each the chambers is communicated with the other through a valve-communication path 54. Ink to be ejected from the printing head 4*a* is filled in the ink storage chamber 52.

In this regard, a system for ejecting ink is not limited but, for example, may be one using thermal energy generated from an electro-thermal converter as the energy for ejecting the ink. In such a case, the film boiling occurs by heat generated from the electro-thermal converter, and the ink is ejected from an ink ejection orifice due to the bubbling energy thereof.

In a portion of the ink storage chamber 52, a flexible buffer sheet 55 is provided and defines a space for storing ink (hereinafter referred to an ink storage space 56) between the same and an outer housing. An outer space relative to the ink storage space 56 as seen from the buffer sheet 55, that is, a buffer space on the right side of the buffer sheet 55 in the drawing is open to outer air to have an atmospheric pressure. Further, the ink storage space 56 forms a substantially sealed space except for an ink supply port 63 located downward and the communication path 54 to the valve chamber 54.

The buffer sheet 55 is formed of a deformable flexible film (a sheet member). A shape of a central portion of the buffer sheet 55 is defined by a buffer pressure plate 57 which is a flat support member so that the peripheral portion thereof is solely deformable. The central portion of the buffer sheet 55 shown in FIG. 6 is convex rightward so that a side profile is generally trapezoidal. Further, the buffer sheet 55 deforms in accordance with amounts of ink or pressure variations in the ink storage space 56. At this time, the peripheral portion of the buffer sheet 55 is stretched or contracted in a well-balanced manner, whereby the central portion of the buffer sheet 55 moves leftward and rightward in the drawing while maintaining the generally vertical posture. Since the buffer sheet 55 smoothly deforms (moves) as described above, there is no shock caused by the deformation and thus the ink storage space 56 is free from the abnormal pressure variation accompanied with the shock.

Buffer springs 58 of a compressive type are provided in the ink storage space 56. The buffer springs 58 generate a pressing force for biasing the buffer sheet 55 rightward via the buffer pressure plate 57. Thereby, a negative pressure enabling the ink ejection generates in the printing head 4*a* to maintain a meniscus formed in the ink ejecting section in a proper state. In this regard, in the state shown in FIG. 6, the ink storage space 56 is almost completely filled with ink. Even in this state, the buffer springs 58 are in a compressed state and generate a proper pressure in the ink storage space 56.

In the valve chamber 53, there are provided with a valve pressing plate 60 having a valve communication port 59 which is a constituent element of the one-way valve, and a valve sheet 61 including a seal member for sealing the valve communication port 59. The valve pressing plate 60 is bonded to the valve sheet 61, and the valve communication port 59 passes through the valve pressing plate 60 and the valve sheet 61. A sealed space is substantially maintained even in the valve chamber, except for the communication path 54 and the valve communication port 59. A space located rightward from the valve sheet 61 in the drawing is open to outer air through an atmosphere communication port 64 and has a pressure equal to the atmospheric pressure.

The valve sheet 61 is deformable in a peripheral portion except for a central portion bonded to the valve pressing plate 60, so that the central portion becomes convex to be of a trapezoidal form in the side view. According to such a construction, the valve pressing plate 60 is smoothly movable leftward and rightward.

In the interior of the valve chamber 53, a valve spring 62 is provided as a valve regulation member for regulating the opening motion of the valve. The valve spring 62 is maintained in a slightly compressed state so that the valve pressing plate 60 is pushed rightward in the drawing due to the reactive force of the compressed valve spring 62. While the valve function is performed by the contact/separation of the valve sheet 61 relative to the valve communication port 64, the introduction of gas into the valve chamber is solely allowed from the atmosphere communication port 64 via the valve communication port 59, whereby the valve chamber 53 functions as a one-way valve mechanism.

A seal member for the valve sheet 61 may be one capable of assuredly sealing the valve communication port 59. That is, the seal member may be made of any material provided a portion to be in tight contact with the valve communication port 59 is maintained flat relative to the open surface. In this regard, since the tight contact is achievable by a stretching force of the valve spring 62, elastomeric material such as rubber is favorably used, which is easily conformable with the valve pressing plate 60 moving due to the stretching force.

Figure 7:
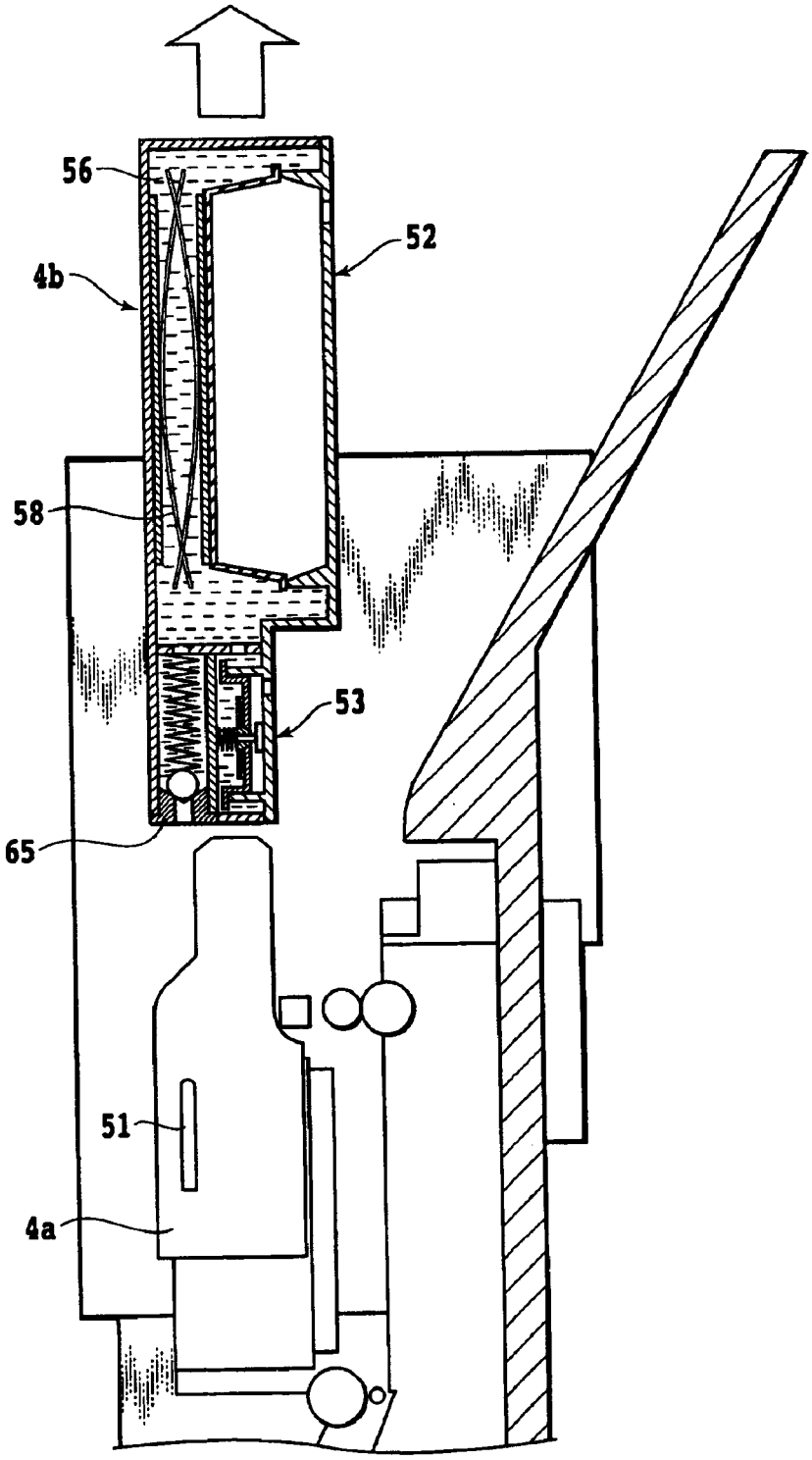
FIG. 7 is an enlarged sectional view illustrating the ink tank of FIG. 6 separated from a printing head.

FIG. 7 illustrates the ink tank 4*b* separated as indicated by an arrow from the printing head 4*a* from the state in which the ink tank 4*b* is mounted to the printing head 4*a* as shown in FIG. 6.

In this embodiment, when the ink in the ink tank has been completely used, the empty ink tank is separated as shown in the drawing, and replaced by a fresh ink tank filled with ink. The coupling of the printing head 4*a* with the ink tank 4*b* is carried out by inserting the ink supply needle 51 provided in the printing head 4*a* into the ink tank 4*b*. Thereby, the both are in fluid communication with each other to supply ink from the ink tank 4*b* to the printing head 4*a*. In this regard, a joint rubber 65 is attached around the ink supply needle 51 to ensure the tight contact of the ink supply needle with the ink tank. A filter is disposed in flow path between the ink supply needle 51 and the printing head 4*a* to prevent impurities mixed with the supplied ink from flowing into the printing head 4*a*.

As described above, for ensuring the stable ink ejection from the printing head 4*a*, a negative pressure of a certain magnitude is necessary sucking ink in the printing element into the interior of the printing head. In the prior art, to generate this negative pressure, an absorbent such as sponge is filled in the ink tank so that a force thereof for sucking ink is used as a negative pressure. However, the filling of the absorbent such as sponge in the interior of the tank causes the reduction of a net ink capacity in the tank. Also, the ink tank is limited in shape due to the process for filling the absorbent in the tank. Contrarily, according to the ink tank 4*b* described above, since the negative pressure is controlled by the buffer springs 58 and the valve chamber 53, it is possible to maintain a negative pressure in a stable state during the ink supplying process even if a large amount of ink is stored in the elongate tank as in this embodiment, or in a tank of an optional shape provided it is capable of storing ink of a liquid type. Also, since no ink is absorbed in the absorbent such as sponge, it is possible to completely use all ink stored in the tank. Thereby, the capacity efficiency of the ink tank itself is improved, and an ink tank suitable for a thin and small-sized printing apparatus is obtainable as applied to this embodiment.

As described above, according to this embodiment, it is possible to realize a thin and small-sized printing apparatus less in installation space by arranging the printing region, the paper-conveying roller region and the ink region on a straight line generally parallel to a plane containing the printing region and vertical to the installation plane of the printing apparatus. Further, by using the ink tank containing no absorbent such as sponge therein in the printing apparatus, it is possible to realize the printing apparatus which is more effective and less in running cost.

(Second Embodiment)

A second embodiment of the present invention will be described below.

In the first embodiment, the ink jet printing apparatus of a thin type used while being disposed in a vertical direction to minimize the installation area has been described. In the second embodiment, an ink jet printing apparatus which is of a thin type but used while being disposed in a horizontal direction will be described.

Figure 8A:
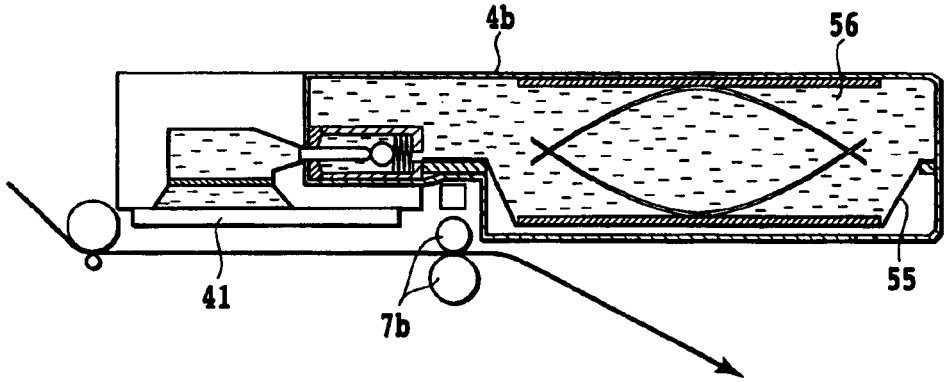
FIGS. 8A and 8B are enlarged sectional views, respectively, for explaining an ink supply path of an ink tank used in a second embodiment of the present invention.
Figure 8B:
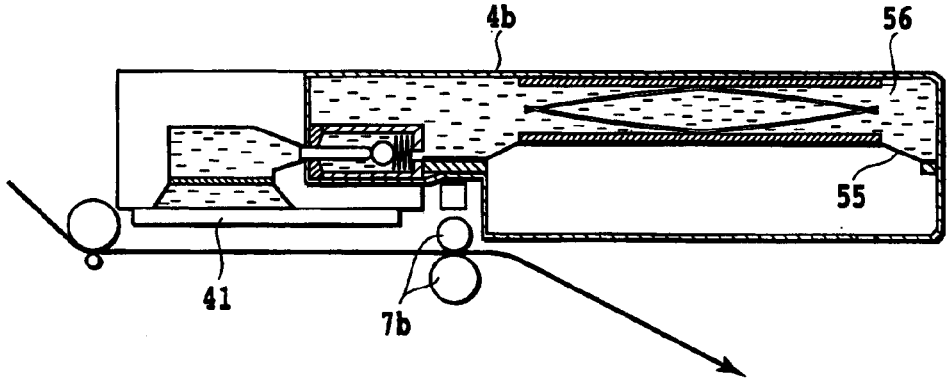

FIGS. 8A and 8B are enlarged sectional views of a portion of the printing apparatus according to this embodiment in the vicinity of the printing region. In these drawings, a plane containing the printing region is generally parallel to the horizontal plane. According to this embodiment, an ink tank similar to that in the first embodiment is arranged and used as shown in the drawings.

FIG. 8A illustrates an initial state in which an ink tank 4*b* is sufficiently filled with ink. In this case, the ink tank in the vicinity of a paper-conveying roller region is located above the paper-conveying roller 7*b*. Accordingly, it is necessary that the ink initially in the ink tank once rises against the gravity as the printing progresses, and then goes down to the printing head. There may be a risk in that such an ink flow disturbs the smooth ink supply in comparison with the conventional method described with reference to FIG. 1 in which the ink is always fed vertically downward.

In this embodiment, however, the ink tank described in the first embodiment is applied and, in the ink storage chamber, the buffer sheet 55 is disposed on the lower side as seen in the vertical direction. Therefore, since a buffer area provided beneath the buffer sheet 55 gradually increases as a space having a pressure equal to the atmospheric pressure as the ink is consumed, the ink in the ink storage chamber is smoothly supplied to the printing head.

FIG. 8B shows a state in which the ink is consumed from the state shown in FIG. 8A and all the residual ink is collected above the paper-conveying roller region. In this state, all the ink in the ink storage space 56 is located above the printing section 41 as seen in the gravity direction. Accordingly, the ink gradually descends in conformity with the gravity in the path and fed to the printing head. At this instant, by introducing outer air through the above-mentioned valve (not shown), all the ink in the interior of the ink tank is delivered to the printing head and completely used.

As described above, according to this embodiment, by arranging the printing region, the paper-conveying roller region and the ink region a straight line generally parallel to the plane containing the printing region and horizontal to the installation plane of the printing apparatus, it is possible to realize the printing apparatus of a low and thin type small in size. Further, by using the ink tank similar to that used in the first embodiment, it is possible to provide a more effective printing apparatus low in running cost.

(Third Embodiment)

A third embodiment will be described below.

Figure 9A:
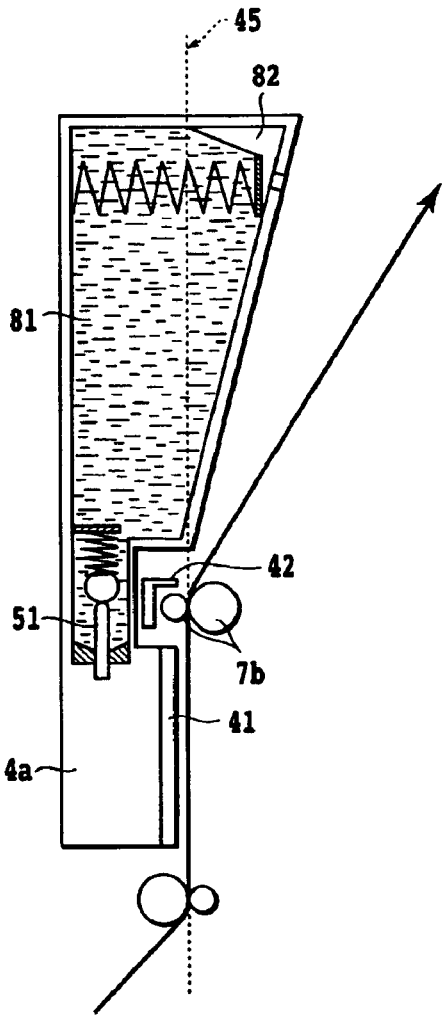
FIGS. 9A and 9B are enlarged sectional view, respectively, for explaining the arrangement of a printing region, a paper feeding region and an ink region in a printing apparatus according to a third embodiment of the present invention.

FIG. 9A is an enlarged sectional view for illustrating the arrangement of a printing region, a paper-conveying roller region and an ink region in this embodiment.

In this embodiment, to realize an ink jet printing apparatus of a thin type used while being disposed in a vertical direction, the printing region, the paper-conveying roller region and the ink region are arranged on a straight line generally parallel to the printing region extension plane and vertical to the installation plane of the printing apparatus in the same manner as in the first embodiment. However, the ink region 81 in this embodiment largely extends from the printing region extension plane opposite to the printing head.

As in FIG. 2 illustrating the first embodiment, to prevent the medium printed by the vertical printing apparatus from falling down, the paper-delivery tray is usually inclined at a certain angle. In such a case, there is a vacant space in a parallelepiped frame which could not be used, in proportional to the inclination of the paper-delivery tray. In this embodiment, it is contemplated to use such a space as the ink region 81 so that the capacity efficiency of the printing apparatus is enhanced.

Figure 9B:
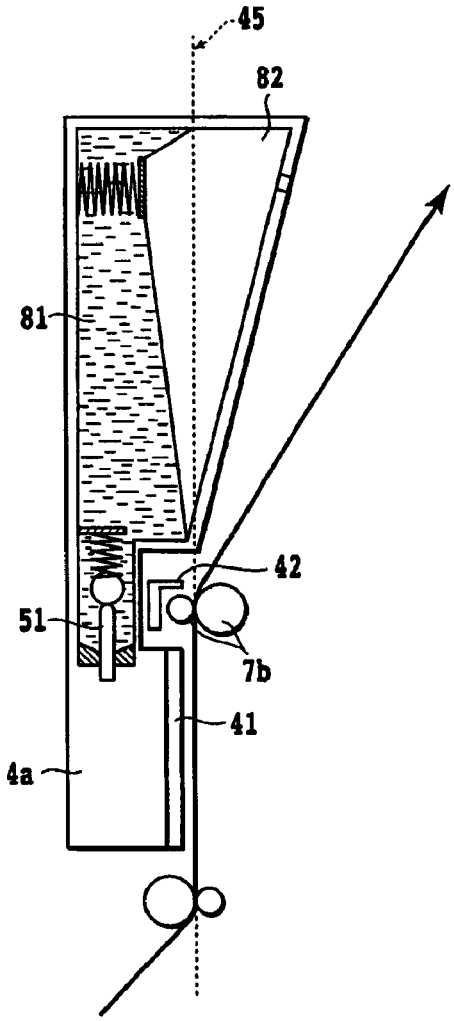

FIG. 9B shows a state in which the ink is being consumed from the state shown in FIG. 9A. Also in this embodiment, the ink tank of the same construction as in the above-mentioned two embodiments is used. After a buffer region 82 partitioned by a buffer sheet to have an interior pressure equal to the atmospheric pressure is sufficiently has extended leftward, outer air is introduced into the ink tank from a valve not shown so that the ink is completely consumed as in the preceding embodiments.

According to this embodiment, while the effect for thinning the printing apparatus is the same as the first embodiment, that for reducing the running cost is more enhanced than the first embodiment because the capacity of the ink tank increases.

In this regard, since a serious consideration is taken in the reduction of running cost in the preceding embodiments, the ink tank shown in FIG. 6 is used, provided with the valve chamber and having no absorbent therein. However, the present invention should not be limited thereto but may be applied to the conventional ink tank having no valve chamber and containing the absorbent such as sponge, provided the three regions; i.e., the printing region, the paper-conveying roller region and the ink region; are arranged on a straight line generally parallel to the plane containing the printing region, as defined by the present invention. Even in the latter case, the effect of the present invention for minimizing a size of the printing apparatus is obtainable.

While the description has been made on the serial type ink jet printing apparatus in all of the above embodiments, the present invention should not be limited thereto. Even in the line printer in which the printing head is not subjected to the scanning motion, the effect of the present invention is sufficiently obtainable, provided the printing region of the printing head, the paper-conveying roller region and the ink region are arranged on a straight line generally parallel to the plane containing the printing region.

Further, while the description has been made concerning liquid ink as an example of printing agent consumed in the printing apparatus, the present invention should not be limited thereto. One of characteristics and effects of the present invention is in that a consumption article such as ink directly related to the running cost of the printing apparatus is stored in the printing apparatus in a manner for facilitating the capacity efficiency. Accordingly, the effect of the present invention is obtainable even if the consumption article is not the liquid ink but may be solid ink or an ink ribbon.

(Fourth Embodiment)

Figure 10:
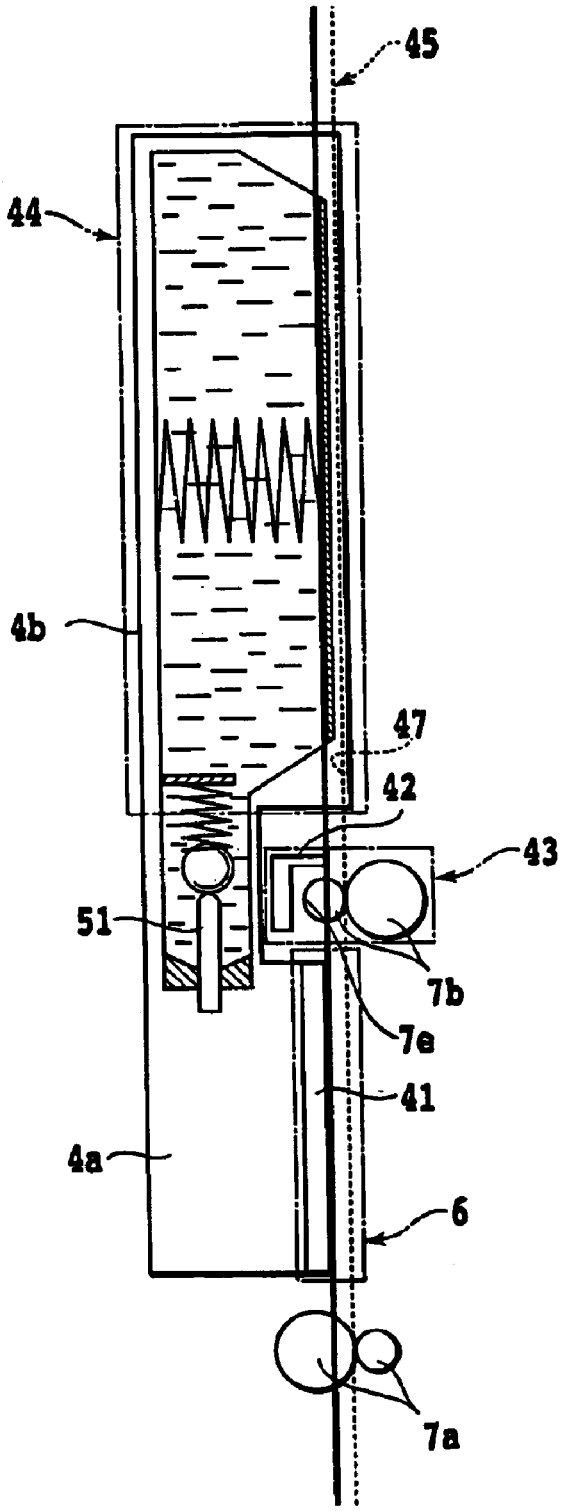
FIG. 10 is an illustration for explaining a fourth embodiment of the present invention.

FIG. 10 illustrates a fourth embodiment of the present invention.

In the fourth embodiment, the recording medium is conveyed in the conveying path 47 from above to below. An upstream pair of paper-conveying rollers 7*a* is of a conventional type. On the other hand, one in a downstream pair of paper-conveying rollers 7*b* disposed closer to the recording head 4*a* is of a gear-shaped nip roller type. Most part of the ink tank 4*b* is disposed upstream of the paper-conveying roller 7*b* which is in turn disposed upstream of the recording head 4*a*, and is shaped to occupy an area including a region closer to the conveying path 47 than the farthermost point 7*e* from the conveying path 47 of the paper-conveying roller 7*b*.

As described hereinabove, according to the present invention, the three important regions relating to the printing operation (the printing region, the paper-conveying roller region and the ink (printing agent) region) are arranged on one straight line so that the extension of the printing region or the ink (printing agent) region is accommodated within an area on the straight line. As a result, the printing apparatus becomes thin and small in size as a whole, and even if the number of the printing elements increases in correspondence to the requirement for the high-speed printing or the capacity of printing agent becomes larger in response to the need for the reduction of running cost, the printing apparatus is not large in size.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus, comprising:

a printing agent container for storing printing agent;

printing means for replenishing the printing agent from said printing agent container and imparting the printing agent to a printing medium from a plurality of printing elements; and a pair of paper-conveying rollers for conveying the printing medium while maintaining the latter in a flat state by supporting the printing medium from front and rear surfaces thereof;

wherein a printing region plane opposite to the printing medium in which said plurality of printing elements of said printing means are arranged, at least part of a paper-conveying roller region occupied with said paper-conveying rollers, and at least part of a printing agent region in which said printing agent container is located, are all arranged on a same straight line contained in said printing region plane, such that said at least part of said paper-conveying roller region is interposed between said printing region plane and at least part of said printing agent region.

2. A printing apparatus as claimed in claim 1, wherein said printing agent region is positioned at a level higher than said printing means in the gravity direction at the operating position of said printing apparatus.

3. A printing apparatus as claimed in claim 1, wherein the printing agent is located in said printing agent container at a lower level in the gravity direction as the printing on the printing medium is proceeding.

4. A printing apparatus as claimed in claim 1, wherein the printing agent is liquid stored in said printing agent container while maintaining a liquid state.

5. A printing apparatus as claimed in claim 1, wherein said printing means has means capable of carrying out the printing operation on the printing medium with motion that is horizontal when said printing apparatus is in its operating position.

6. A printing apparatus as claimed in claim 1, wherein the printing agent is liquid ink and said printing element has an ejection orifice for ejecting ink and an element for generating energy used for ejecting the ink from said ejection orifice.

7. A printing cartridge having a configuration capable of being mounted to said printing apparatus as claimed in claim 1, comprising:

a printing agent container for storing printing agent; and printing means for replenishing the printing agent from said printing agent container and imparting the printing agent to a printing medium from a plurality of printing elements.

8. A printing agent container detachably mounted to said printing means constituting said printing cartridge as claimed in claim 7.

9. A printing agent container detachably mounted to said printing means used in said printing apparatus as claimed in claim 1.

10. A printing apparatus for carrying out the printing operation by using printing means, comprising:

a first conveying roller for conveying a printing medium on a predetermined conveying path, holding means disposed on said conveying path downstream of said first conveying roller, for holding the printing means, a second conveying roller for conveying the printing medium disposed on said conveying path downstream of said holding means, and a printing material container held by said holding means or said recording means, and extending over said conveying path to a position further downstream of said second conveying roller and closer to said conveying path than the farthest point from said conveying path of said second conveying roller.

11. A printing apparatus as claimed in claim 10, wherein said printing material comprises ink, and said printing means carrying out the printing operation by discharging said ink.

12. A printing apparatus for carrying out said printing operation by using printing means, comprising:

a first conveying roller for conveying a recording medium on a predetermined conveying path, holding means disposed on said conveying path downstream of said first conveying roller, for holding the recording means, a second conveying roller disposed on said conveying path downstream of said holding means, and a recording material container held by said holding means or said recording means, and extending over said conveying path to a position further upstream of said first conveying roller and closer to said conveying path than the farthest point from said conveying path of said first conveying roller.

13. A printing apparatus as claimed in claim 12, wherein said printing material comprises ink, and said printing means carrying out the printing operation by discharging said ink.

* * * * *